US012060246B2

(12) United States Patent
Kim

(10) Patent No.: US 12,060,246 B2
(45) Date of Patent: Aug. 13, 2024

(54) FRICTION SHAFT FOR SLITTER

(71) Applicant: Byung Hwa Kim, Seoul (KR)

(72) Inventor: Byung Hwa Kim, Seoul (KR)

(73) Assignee: Byung Hwa Kim, Seoul (KR)

( * ) Notice: Subject to any disclaimer, the term of this patent is extended or adjusted under 35 U.S.C. 154(b) by 231 days.

(21) Appl. No.: 17/893,388

(22) Filed: Aug. 23, 2022

(65) Prior Publication Data

US 2023/0093065 A1 Mar. 23, 2023

(30) Foreign Application Priority Data

Sep. 17, 2021 (KR) ..... 10-2021-0124608
May 12, 2022 (KR) ..... 10-2022-0058173

(51) Int. Cl.
*B65H 75/24* (2006.01)
*B65H 75/50* (2006.01)

(52) U.S. Cl.
CPC ..... *B65H 75/243* (2013.01); *B65H 75/50* (2013.01); *B65H 2402/54* (2013.01)

(58) Field of Classification Search
CPC ..... B65H 75/24; B65H 75/50; B65H 75/242; B65H 75/243; B65H 2301/4148; B65H 18/04; B65H 18/106
See application file for complete search history.

(56) References Cited

U.S. PATENT DOCUMENTS 6,405,970 B1 * 6/2002 Ueyama ..... B65H 75/243 242/576.1
10,829,339 B2 * 11/2020 Lee ..... B65H 18/04
10,843,886 B2 * 11/2020 Lee ..... B65H 18/021

* cited by examiner

*Primary Examiner* — Sang K Kim
(74) *Attorney, Agent, or Firm* — IP & T GROUP LLP

(57) ABSTRACT

Proposed is a friction shaft for a slitter that enables a winding pipe to stably roll unit materials formed by cutting a raw material, such as a raw fabric or film, with predetermined intervals, that can fix the rolling pipe even at a low pressure of compressed air, and that has a wide range of available rolling tension because the pressure range of compressed air that can adjust winding torque is wide.

14 Claims, 23 Drawing Sheets

FRICTION SHAFT FOR SLITTER

CROSS REFERENCE TO RELATED APPLICATION

The present application claims priority to Korean Patent Application Nos. 10-2021-0124608, filed on Sep. 17, 2021, and 10-2022-0058173, filed on May 12, 2022, the entire contents of which is incorporated herein for all purposes by this reference.

BACKGROUND OF THE INVENTION

Field of the Invention

The present disclosure relates to a friction shaft for a slitter and, more particularly, a friction shaft for a slitter that enables a winding pipe to stably roll unit materials formed by cutting a raw material, such as a raw fabric or film, with predetermined intervals, that can fix the rolling pipe even at a low pressure of compressed air, and that has a wide range of available rolling tension because the pressure range of compressed air that can adjust winding torque is wide.

Description of the Related Art

In general, a slitter is an apparatus that cuts raw materials such as various kinds of paper, fabric, or film with predetermined intervals. Reel cores are used to roll several unit materials formed by a slitter.

Accordingly, a friction shaft for a slitter that rotates a reel core using compressed air was used to roll several unit materials, such as various kinds of paper, fabric, or film, on a reel core.

In relation to this, a rolling apparatus in which ventilation holes are formed on the outer surface of a roller shaft having an air channel at the center therein and several friction cores are inserted therein has been disclosed in Patent Document 1. The rolling apparatus is characterized in that exposure holes, reciprocation holes, and operation chambers are formed at several positions through the friction cores, operators having a curve on the bottom are inserted in the reciprocation holes and the operation chambers with predetermined intervals on the operation chambers, an O-ring is inserted in the operators in the reciprocation holes, an O-ring is fitted on the inner shaft portions of the top of the operators in the operation chambers, and a pressing plate is inserted in the exposure holes, whereby the friction cores fastened to the upper portions of the operators are fitted on the rolling shaft.

However, according to Patent Document 1, compressed air leaks to the operation chambers close to the reciprocation holes, so the pressure of the compressed air is applied to the operators from both above and below.

That is, movement of the operators for protruding the pressing plates from the friction core was not made well.

Accordingly, close contact as not made well between the pressing plates and the reel core, so it was difficult to fix the reel core and there was a possibility that rolling by the reel core is poor.

Accordingly, it was unavoidable to increase the pressure of compressed air in order to stably fix the reel core with the pressing plates.

That is, the pressure range of compressed air that can adjust rolling torque was unavoidably very narrow.

Documents of Related Art

Patent Document (Patent document 1) Korean Patent Publication No. 1995-0008032 (published Jul. 24, 1995)

SUMMARY OF THE INVENTION

Accordingly, an objective of the present disclosure is to provide a friction shaft for a slitter that enables a winding pipe to stably roll unit materials formed by cutting a raw material, such as a raw fabric or film, with predetermined intervals in comparison to the related art, that can fix the rolling pipe even at a low pressure of compressed air in comparison to the related art, and that has a wide range of available rolling tension in comparison to the related art because the pressure range of compressed air that can adjust winding torque is wide in comparison to the related art.

In order to achieve the objectives of the present disclosure, there is provided a friction shaft for a slitter that is configured such that winding pipes for rolling unit materials, which are formed by cutting a raw material such as various kinds of paper, fabric, or film with predetermined intervals, are disposed on an outer surface thereof.

In detail, disclosed is a friction shaft for a slitter that includes a rotary shaft having an air supply channel formed at a center therein to be supplied with compressed air in a longitudinal direction; and several friction cores disposed on the rotary shaft to be able to rotate at positions thereof, in which several air supply holes connected to the air supply channel are formed circumferentially on an outer surface of the rotary shaft so that compressed air in the friction cores can be supplied, and the friction cores each include: a core pipe having a through-hole formed at the center thereof to be fitted on the rotary shaft, an insertion groove formed in a ring shape at a center on an inner surface thereof to face the air supply hole, and exposure holes circumferentially formed on an outer surface thereof and connected to the insertion groove and connection holes; bearings disposed at both sides of the through-hole; sealing rings disposed between the insertion groove and the pair of bearings, respectively; a cylindrical tube configured to cover and finish the insertion groove between the pair of sealing rings, and configured to be expanded by compressed air that is supplied from the air supply hole; clamping lugs disposed in the insertion groove, the connection holes, and the exposure holes and configured to be partially protruded from the exposure holes by expansion of the tube to come in close contact with a winding pipe; and elastic members disposed between the insertion groove and the clamping lugs to partially insert the clamping lugs back into the exposure holes when supply of the compressed air is stopped.

According to the present disclosure, since a tube prevents leakage of compressed air to an insertion groove of a core pipe, there is an effect that pressure of the compressed air is transmitted to only one side unlike the related art.

Further, since the surface of a clamping lug that receives pressure of compressed air to fix a winding pipe is wide and hard in comparison to the related art, there is an effect that a large force is effectively transmitted to the winding pipe.

That is, there is an effect that the clamping lug is easily protruded from a friction core and brought in close contact with the winding pipe by compressed air in comparison to the related art.

Accordingly, the winding pipe is stably fixed on the clamping lug, so there is an effect that the winding pipe can stably roll unit materials formed by cutting a raw material, such as various kinds of paper, fabric, or film, with predetermined intervals in comparison to the related art.

Further, there is an effect pressure of compressed air that is used to fix the winding pipe is reduced.

According to the present disclosure, when compressed air is further supplied, the groove of a sealing ring expands and the friction between the rotary shaft and the friction core increases, so there is an effect that a friction force for increasing the winding tension of the winding pipe is obtained.

That is, there is an effect that it is possible to adjust the friction between the rotary shaft and the friction core and to adjust the winding tension by adjusting the pressure of compressed air.

In other words, since it is possible to increase the use range of winding tension in comparison to the related art, there is an effect that it is possible to roll more various products including not only various kinds of paper, fabric, or film that require low tension, but various kinds of paper, fabric, or film that require high tension.

According to the present disclosure, since an insertion plate and a close-contact plate are fastened by fasteners, there is an effect that when the close-contact plate is damaged by friction with the winding pipe, it is possible to separate and repair the close-contact plate.

According to the present disclosure, since a first elastic plate and first elastic supporting bridges are inserted and supported between the insertion groove and the insertion plate, there is an effect that the clamping lug is easily returned to the initial position after rolling.

Further, since the protrusion of the insertion plate passes through the through-hole of the first elastic plate, there is an effect that the elastic member is simply installed.

According to the present disclosure, since second and third elastic supporting bridges are inserted and supported in the insertion groove with second and third elastic plates supported on first and second planes, there is an effect that the clamping lug is easily returned to the initial position after rolling.

Further, since the protrusion of the insertion plate passes through the through-hole of the second elastic plate, there is an effect that the elastic member is simply installed.

Further, since the third elastic plate is fastened to be fixed to the insertion plate by fasteners, there is an effect that the third elastic plate does not shake on the insertion plate in rolling.

According to the present disclosure, since the insertion plate has large length and width, there is an effect that the area of the clamping lug that receives pressure of compressed air to fix the winding pipe is increased.

That is, there is an effect that the force of the clamping lug that fixes the winding pipe increases even at a low pressure of compressed air in comparison to the related art.

In other words, there is an effect that pressure of compressed air that is used to fix the winding pipe is reduced.

According to the present disclosure, since the close-contact portion of the core pipe is fitted between the fitting portions of the tube, there is an effect that the gap through which compressed air may leak to the insertion groove is further sealed.

According to the present disclosure, there is an effect that the sealing ring is fixed on the inner surface of the core pipe by a washer and a fixing ring and the fitting portion of the tube is further brought in close contact with the close-contact portion of the core pipe by pressure of the fixing ring.

That is, there is an effect that the gap through which compressed air may leak to the insertion groove is further sealed.

According to the present disclosure, since a close-contact protrusion compressed by pressure the fixing ring is returned by elasticity, there is an effect that the gap through which compressed air may leak to the insertion groove is further sealed.

According to the present disclosure, since the close-contact portion is fitted in the fitting groove formed between the fitting portion and the protrusion, there is an effect that the tube is further fixed on the inner surface of the core pipe and the gap through which compressed air may leak to the insertion groove is further sealed.

According to the present disclosure, since a first protrusion or a second protrusion compressed by pressure the fixing ring is returned by elasticity, there is an effect that the gap through which compressed air may leak to the insertion groove is further sealed.

According to the present disclosure, since coil springs are inserted and supported between the insertion groove and the insertion plate, there is an effect that the clamping lug is easily returned to the initial position after rolling.

BRIEF DESCRIPTION OF THE DRAWINGS

The above and other objectives, features and other advantages of the present invention will be more clearly understood from the following detailed description when taken in conjunction with the accompanying drawings, in which.

DETAILED DESCRIPTION OF THE INVENTION

Figure 1:
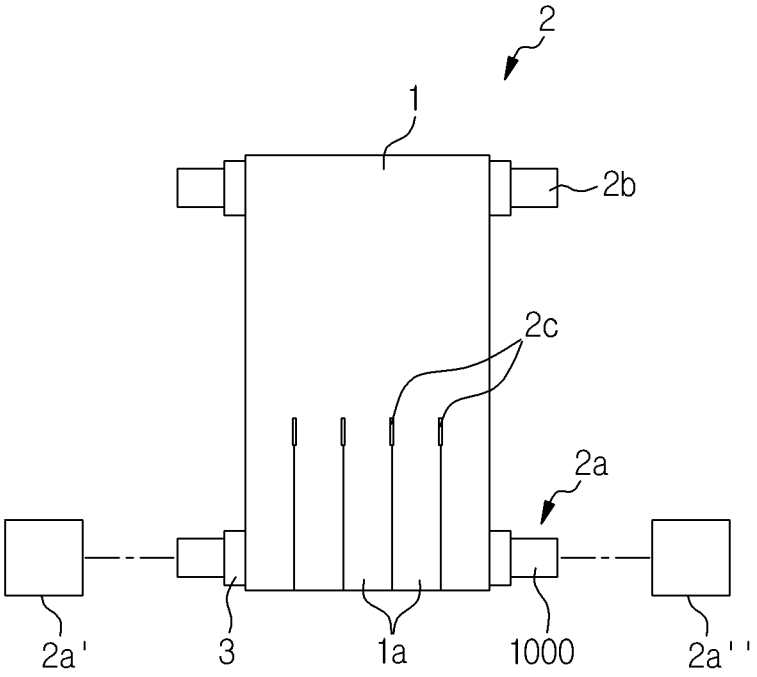
FIG. 1 is a view showing an installation state of a friction shaft for a slitter according to an embodiment of the present disclosure.
Figure 2:
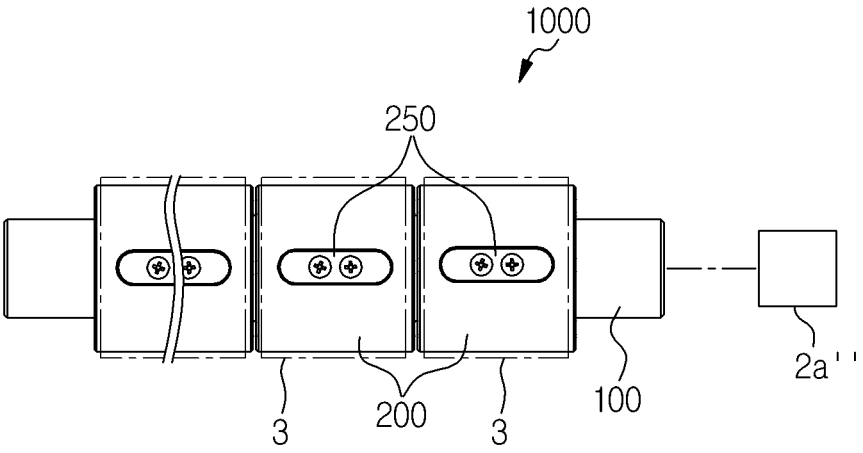
FIG. 2 is a front view of the friction shaft for a slitter according to an embodiment of the present disclosure.
Figure 3:
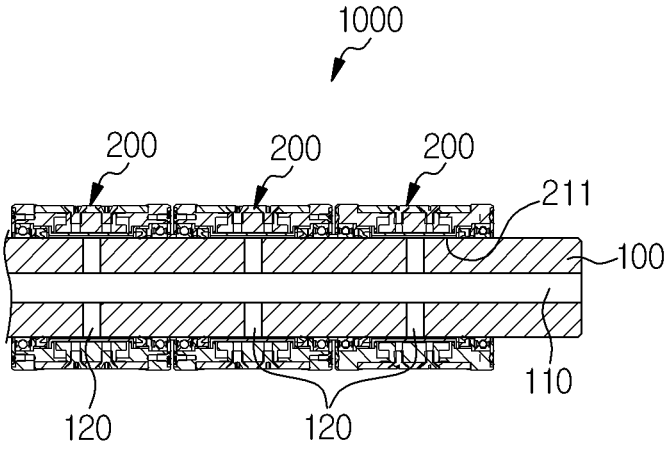
FIG. 3 is a cross-sectional view of the friction shaft for a slitter according to an embodiment of the present disclosure.
Figure 4:
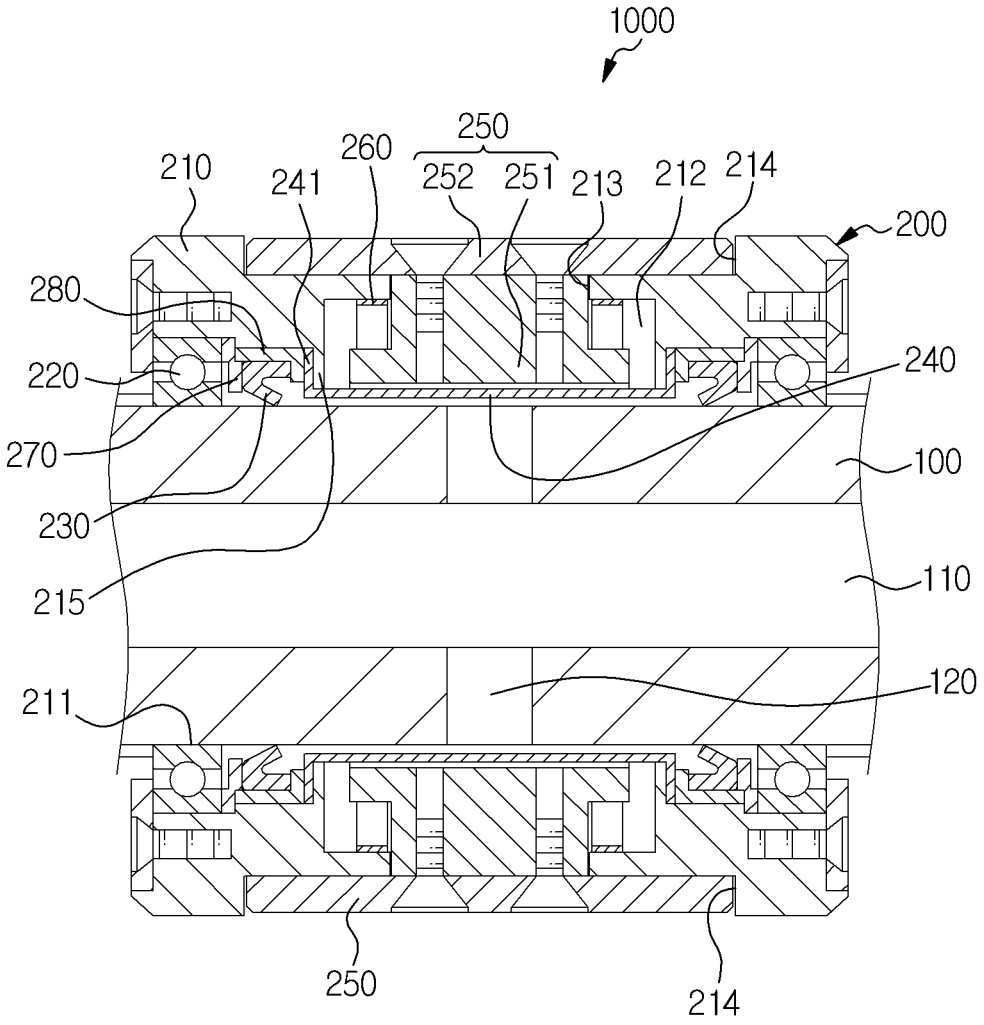
FIGS. 4 to 10 are partial enlarged cross-sectional views and detailed views of the friction shaft for a slitter according to an embodiment of the present disclosure.
Figure 5:
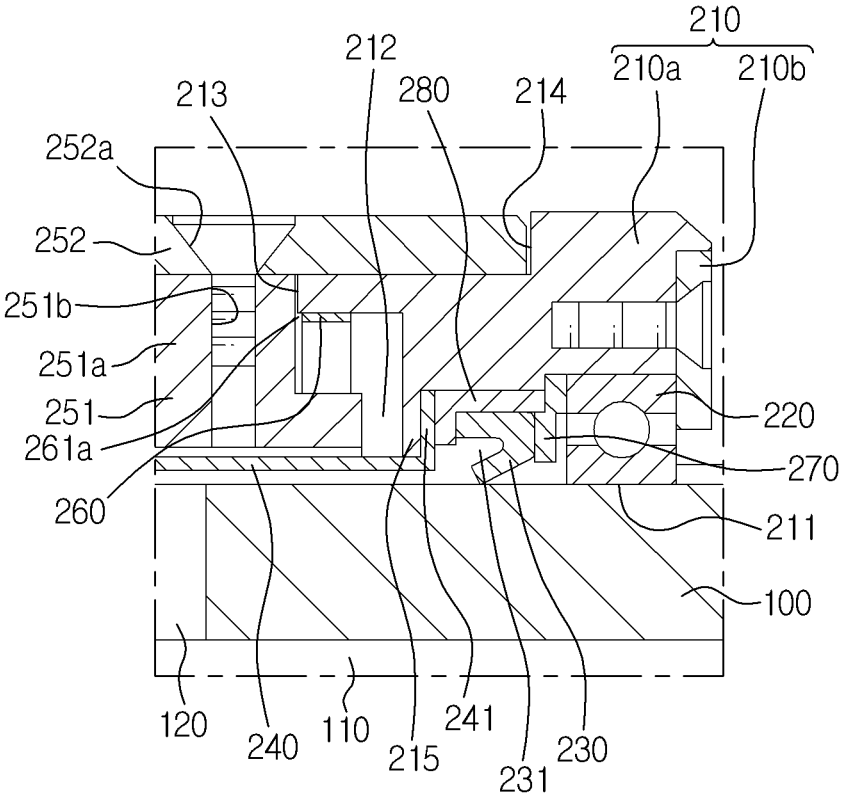
Figure 6:
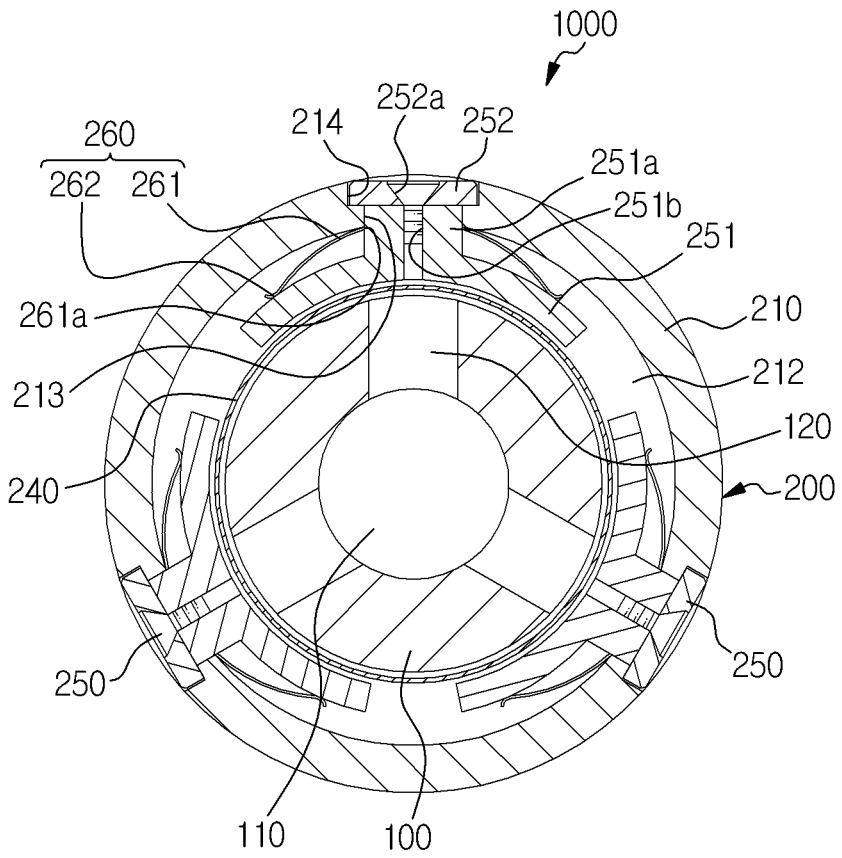
Figure 7:
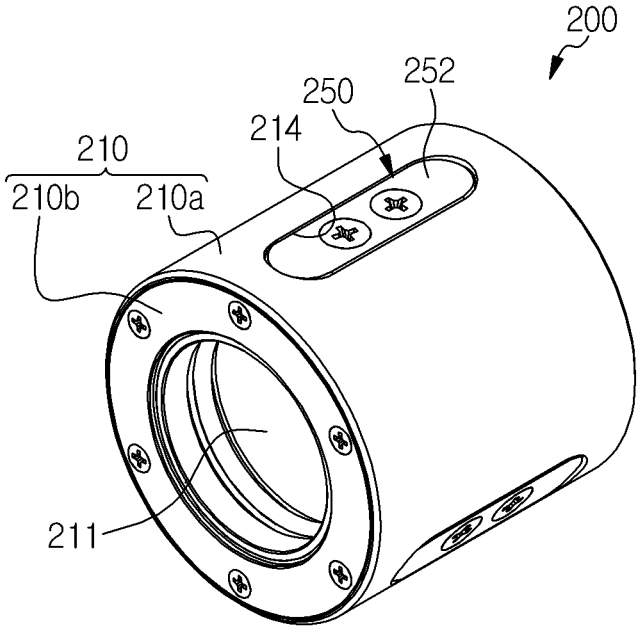
Figure 8:
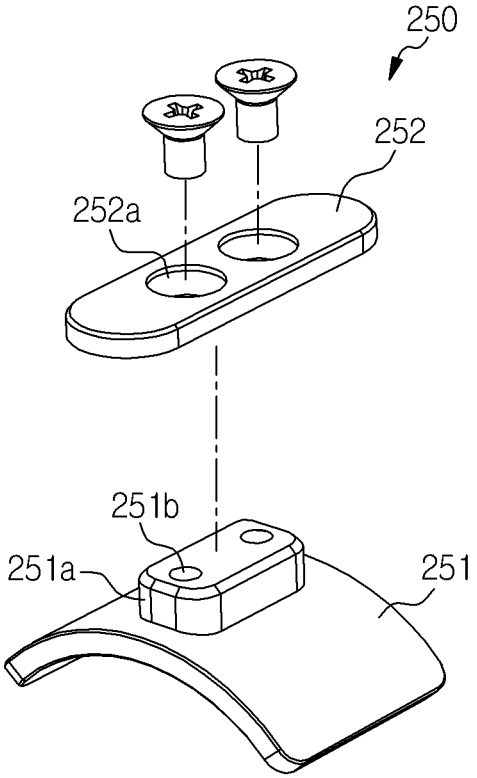
Figure 9:
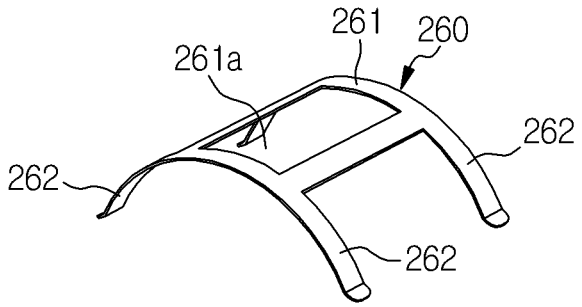
Figure 10:
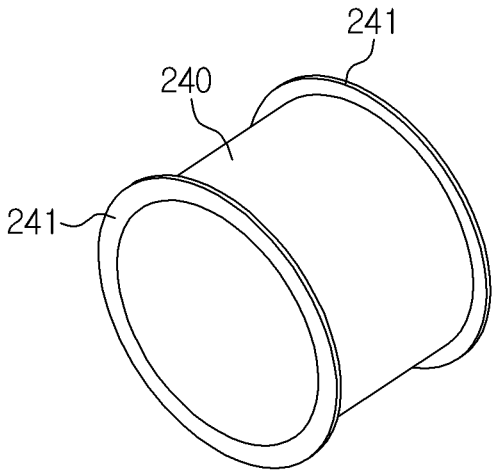
Figure 11:
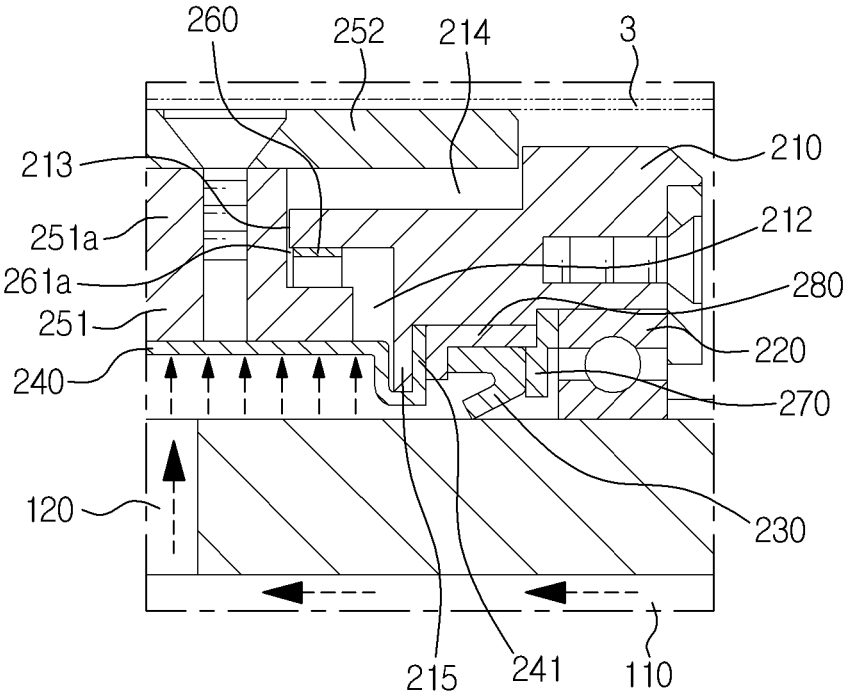
FIGS. 11 to 13 are views showing a use state of the friction shaft for a slitter according to an embodiment of the present disclosure.
Figure 12:
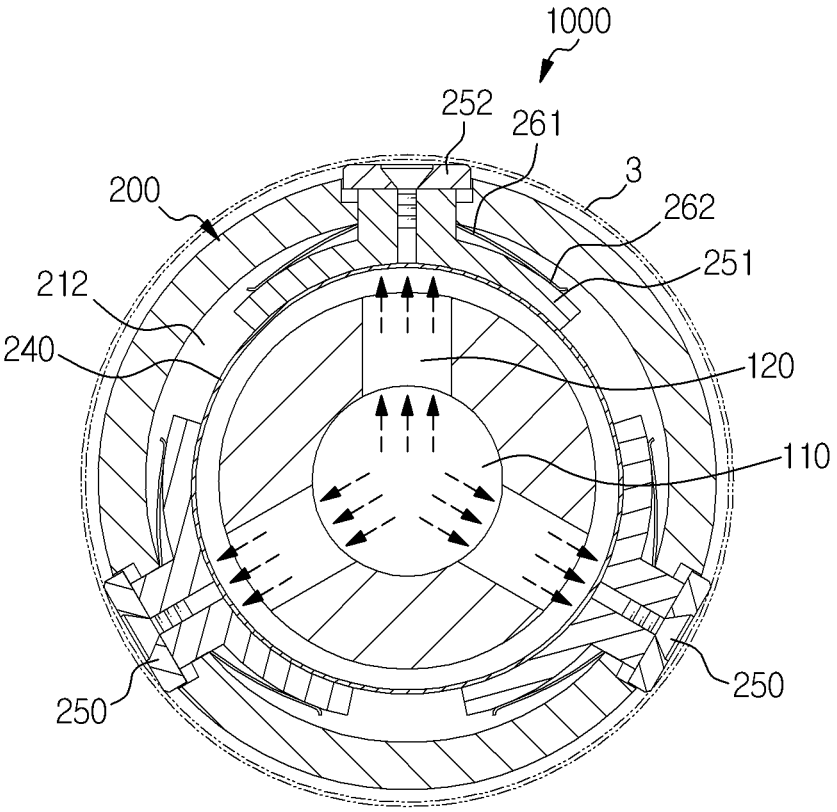

Hereinafter, configurations of exemplary embodiments of the present disclosure will be described with reference to the accompanying drawings.

As shown in FIGS. 1 to 13, a friction shaft 1000 for a slitter according to an embodiment and first to eighth modified examples of the present disclosure is installed on a slitter 2 that includes: a feeder 2*b* that feeds a rolled raw material 1 such as various kinds of paper, fabric, or film to a winder 2*a*; cutters 2*c* that cut the raw material 1 with predetermined intervals; and the winder 2*a* that rolls unit materials 1*a* cut with predetermined intervals from the raw material 1 on a winding pipe 3.

That is, the friction shaft 1000 for a slitter is installed on the winder 2*a* of the slitter 2.

The raw material 1 may be printed with several same shapes or symbols through printing before the raw material 1 is cut into unit materials 1*a*.

The winder 2*a* includes an actuator 2*a*' including a driving motor that rotates the friction shaft 1000 for a slitter, etc., an air supplier 2*a*" supplying compressed air to the friction shaft 1000 for a slitter such as an air compressor, etc.

Several unit materials 1*a* are formed and several winding pipes 3 corresponding to the unit materials are also disposed on the outer surface of the friction shaft 1000 for a slitter.

The winding pipes 3 are reel cores, FRP cores, or the like.

As shown in FIGS. 1 to 13, the friction shaft 1000 for a slitter according to an embodiment of the present disclosure includes: a rotary shaft 100 that is rotated by the actuator 2*a*' and has an air supply channel 110 formed at the center therein to be supplied with compressed air in the longitudinal direction from the air supplier 2*a*"; and friction cores 200 that is disposed on the rotary shaft 100 to be able to rotate at the positions thereof and on which the winding pipes 3 are installed.

The friction cores 200 are disposed with the gaps therebetween maintained by spacers disposed on the rotary shaft 100 and are maintained at their positions by fixing members disposed on the rotary shaft 100.

The rotary shaft 100 may be made of metal, or the like.

Air supply holes 120 that are connected to the air supply channel 110 are formed circumferentially on the outer surface of the rotary shaft 100 so that the compressed air in the friction cores 200 can be supplied.

The air supply holes 120 are formed on the rotary shaft 100 circumferentially with predetermined intervals.

The friction core 200 includes a core pipe 210 that has a through-hole 211 formed at the center to be fitted on the rotary shaft 100, an insertion groove 212 formed in a ring shape at the center on the inner surface thereof to face the air supply hole 120, and exposure holes 214 circumferentially formed on the outer surface thereof and connected to the insertion groove 212 and connection holes 213.

The connection holes 213 are smaller in size than the exposure holes 214.

The exposure holes 214 are formed on the core pipe 210 circumferentially with regular intervals to face the air supply hole 120 and the core pipe 210 is made of metal, or the like.

The friction core 200 includes: bearings 220 disposed at both ends of the through-hole 211, respectively; sealing rings 230 disposed between the insertion groove 212 and the pair of bearings 220, respectively; and a cylindrical tube 240 covering and finishing the insertion groove 212 between the pair of sealing rings 230 and configured to be expanded by compressed air that is supplied from the air supply hole 120.

A groove 231 facing the tube 240 is formed on each of the pair of sealing rings 230 and the sealing rings 230 are retainers made of rubber, etc.

The tube 240 is formed in a cylindrical shape with an open center, is disposed around the rotary shaft 100 not in close contact with the rotary shaft 100, and is made of rubber, or the like.

The bearings 220 are ball bearings.

The friction core 200 includes: clamping lugs 250 disposed in the insertion groove 212, the connection holes 213, and the exposure holes 214 and partially protruded from the exposure holes 214 by expansion of the tube 240 to come in close contact with the winding pipe 3; and elastic members 260 disposed between the insertion groove 212 and the clamping lugs 250 to partially insert the clamping lugs 250 back into the exposure holes 214 when supply of the compressed air is stopped.

The clamping lug 250 and the elastic member 260 may be made of metal, or the like.

The clamping lug 250 includes: an insertion plate 251 curved to be inserted in the insertion groove 212, having a protrusion 251*a* protruding from the center of the outer surface thereof to be inserted in the connection hole 213, and having fastening holes 251*b* formed on the outer surface of the protrusion 251*a*; and a contact plate 252 inserted in the exposure hole 214, having fastening holes 252*a* formed on the outer surface thereof for fastening to the fastening holes 251*b* by fasteners, and being in close contact with the inner surface of the winding pipe 3.

The fastening holes 251*b* and 252*a* are female-threaded holes that are fastened to the male-threaded portions of fasteners.

The elastic member 260 is disposed between the insertion groove 212 and the insertion plate 251.

The elastic member 260 has: a first elastic plate 261 having a through-hole 261 on the outer surface thereof to be fitted on the protrusion 251*a* and curved to be supported in the insertion groove 212; and first elastic supporting bridges 262 formed on the outer surface of the first elastic plate 261 at both sides of the through-hole 261*a* and supported on the insertion plate 251.

The first elastic supporting bridges 262 protrude from the corners of the outer surface of the first elastic plate 261, respectively.

Fitting portions 241 protrude from both ends of the outer surface of the tube 240, respectively.

Close-contact portions 251 that are fitted between the pair of fitting portions 241 are formed on the inner surface of the core pipe 210 at both sides of the insertion groove 212, respectively.

The friction core 200 further includes: washers 270 disposed between the bearings 220 and the sealing rings 230 in close contact with the outer races of the bearings 220; and fixing rings 280 disposed between the washers 270 and the fitting portions 241 to fix the sealing rings 230 between the washers 270 and the fixing rings 280.

The washers 270 are made of metal, or the like, and are not in close contact with the rotary shaft 100 and the inner races of the bearings 220.

The fixing rings 280 are made of metal, or the like, and are not in close contact with the rotary shaft 100.

The fixing rings 280 press the fitting portions 241 toward the close-contact portions 215.

The core pipe 210 includes: a body 210*a* having the through-hole 211, the insertion groove 212, the connection holes 213, the exposure holes 214, and the close-contact portions 215; and covers 210*b* having the through-hole 211 and coupled to the body 210*a* to fix the bearings 220, the sealing rings 230, the tube 240, the washers 270, and the fixing rings 280 to the body 210*a*.

The operation and effects of the friction shaft 1000 for a slitter having the configuration of the present disclosure described above, as shown in FIGS. 1 to 13, are described hereafter.

Several winding pipes 3 are fitted on several friction cores 200 of the friction shaft 100 for a slitter to be able to roll several unit materials 1*a* formed by cutting a raw material 1, such as various kinds of paper, fabric, or film, with predetermined intervals.

Compressed air is supplied to the air supply channel 110 of the rotary shaft 100 from the air supplier 2*a*″.

The compressed air is supplied into the friction cores 200 through several air supply holes 120 while flowing through the air supply channel 110.

That is, the compressed air is supplied into the tube 240.

Since the insertion groove 212 of the core pipe 210 is covered and finished by the tube 240, the gap between the tube 240 and the insertion groove 212 is sealed.

That is, the compressed air does not leak to the insertion groove 212 of the core pipe 210.

Since the fitting portions 241 of the tube 240 is pressed in close contact with the close-contact portions 215 of the core pipe 210 by the fixing rings 280, the gap between the tube 240 and the insertion groove 212 is further sealed.

That is, the compressed air does not leak to the insertion groove 212 of the core pipe 210.

The gaps between the rotary shaft 100 and the friction cores 200 are sealed by the pair of sealing rings 230 disposed at both sides of the tube 240, respectively.

That is, the compressed air cannot be discharged to the outside through the gap between the rotary shaft 100 and the friction cores 200.

The tube 240 presses the insertion plates 251 of the clamping lugs 250 while being expanded into the insertion groove 212 by the compressed air that is supplied through the air supply holes 120.

Accordingly, the insertion plates 251 are moved toward the outside of the friction cores 200 along the insertion groove 212 by the pressure of the expanding tube 240, and the protrusions 251*a* of the insertion plates 251 are also moved toward the outside of the friction cores 200 along the connection holes 213 and the through-holes 261*a* of the elastic members 260.

Since the compressed air does not leak to the insertion groove 212, the insertion plates 251 receive the pressure of the compressed air, which expands the tube 240, at only one side, so the insertion plates 251 is easily moved toward the outside of the friction core 200 through the insertion groove 212.

The elastic members 260 are compressed while the first elastic plates 261 and the first elastic supporting bridges 262 are deformed by the insertion plates 251.

The contact plates 252 of the clamping lugs 250 protrude through the exposure holes 214 and come in close contact with the inner surfaces of the winding pipes 3.

That is, the winding pipes 3 are fixed to the friction cores 200.

Next, the rotary shaft 100 is rotated by driving the actuator 2*a*′.

Accordingly, the friction cores 200 are rotated with the rotary shaft 100 by the bearings 220.

Further, the winding pipes 3 is rotated with the friction cores 200 by friction on the contact plates 252 of the clamping lugs 250 being in close contact with the inner surface thereof.

Accordingly, the winding pipes 3 roll the unit materials 1*a* with winding tension.

When the unit materials 1*a* are rolled on the winding pipes 3, compressed air is stopped being supplied to the rotary shaft 100 and the operation of the actuator 2*a*' is stopped.

Accordingly, the tube 240 contracts into the initial state due to reduction of the compressed air and the contact plates 252 of the clamping lugs 250 are inserted back into the exposure holes 214 by an elastic return force with the first elastic plates 261 and the first elastic supporting bridges 262 of the elastic members 260 compressed.

The contact plates 252 of the clamping lugs 250 come off the inner surface of the winding pipes 3.

Then, the winding tubes 3 with the unit materials 1*a* rolled thereon, respectively, are pulled out from the friction shaft 1000 for a slitter of the present disclosure, whereby rolling is finished.

Meanwhile, when the raw material 1 is thick and heavy, in order to increase the winding tension of the winding pipes 3, compressed air corresponding to the winding tension is further supplied to the air supply channel 110 of the rotary shaft 100.

Figure 14:
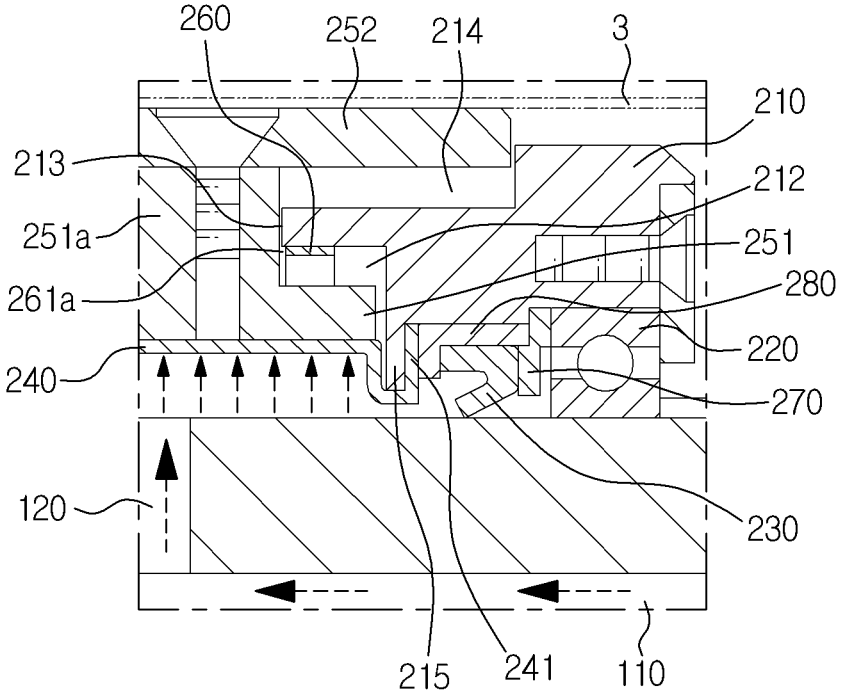
FIGS. 14 and 15 are views showing a use state of the friction shaft for a slitter according to a first modified example of an embodiment of the present disclosure.

Accordingly, internal pressure of the tube 240 is increased by the pressure of the further supplied compressed air, and as shown in FIG. 14, grooves 231 of the pair of sealing rings 230 disposed at both sides of the tube 240 are deformed and expanded.

The sealing rings 230 with the expanded grooves 231 further come in close contact with the rotary shaft 100, thereby increasing friction.

That is, the friction shaft 1000 for a slitter obtains a rotation force for increasing the winding tension of the winding pipes 3.

The tube 240 expands into the insertion plates 251 and further presses the insertion plates 251 of the clamping lugs 250 due to the further supplied compressed air.

The contact plates 252 of the clamping lugs 250 protrude through the exposure holes 214 and further come in close contact with the inner surfaces of the winding pipes 3.

Figure 13:
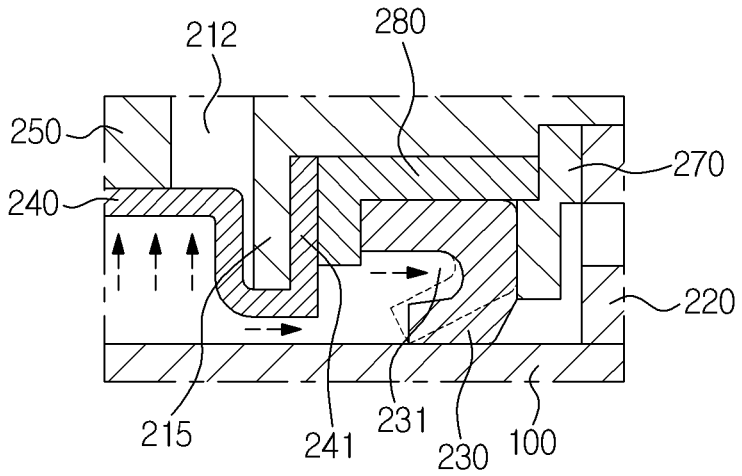

That is, as shown in FIG. 13, as the pressure of the compressed air increases, the winding tension of the winding pipe 3 increases.

Accordingly, the winding pipes 3 roll several unit materials 1*a*, which are thick and heavy, using the increased winding tension.

Figure 15:
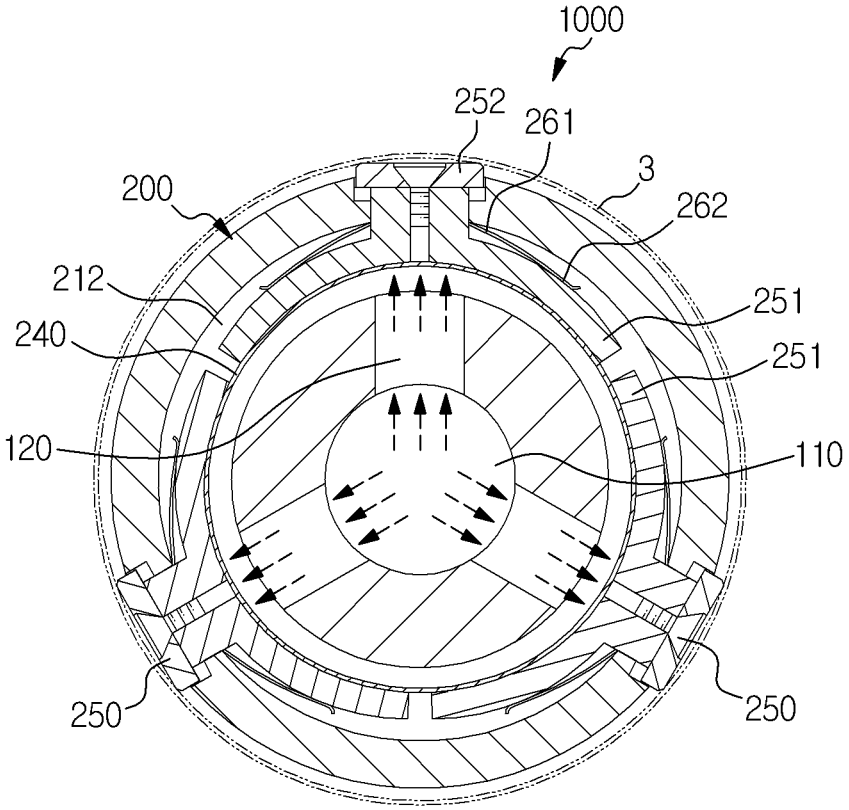

Meanwhile, as shown in FIGS. 14 and 15, in the friction shaft 1000 for a slitter according to a first modified example of an embodiment of the present disclosure, the length of an insertion plate 251 in the circumferential direction of the core pipe 210 is set large such that the insertion plate 251 is adjacent to an adjacent insertion plate 251.

That is, the lengths of the insertion plates 251 are set such that the insertion plates 251 are adjacent to each other.

The width of insertion plates 251 in the longitudinal direction of the core pipe 210 is set large to be close to the width of the insertion groove 212.

Accordingly, when compressed air is supplied into the tube 240 through the air supply holes 120, the tube 240 presses the insertion plates 251 of the clamping lugs 250 while expanding.

Since the insertion plates 251 were increased in length and width in this example, the contact areas with the expanding tube 240 increase in comparison to the first embodiment.

That is, the areas of the insertion plates 251 through which the pressure of compressed air is transmitted increase in comparison to the first embodiment.

Further, due to the increase of the areas of the insertion plates 251 through which the pressure of compressed air is transmitted, the contact plates 252 of the clamping lugs 250 are brought in close contact with the inner surfaces of the winding pipes 3 by a larger force while protruding through the exposure holes 214.

That is, the winding pipes 3 are further fixed to the friction cores 200.

Figure 16:
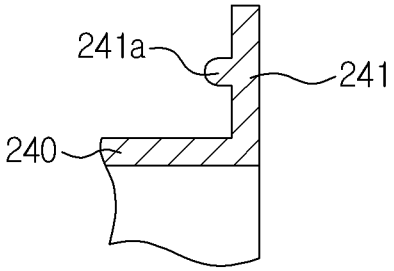
FIGS. 16 and 17 are partial enlarged cross-sectional views of the friction shaft for a slitter according to a second modified example of an embodiment of the present disclosure.
Figure 17:
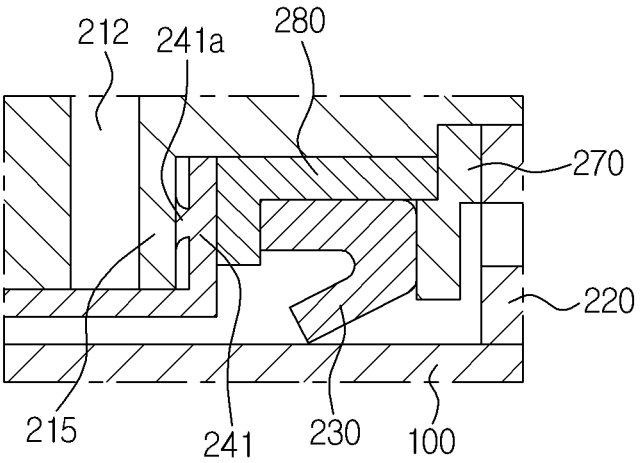

Meanwhile, as shown in FIGS. 16 and 17, in the friction shaft 1000 for a slitter according to a second modified example of an embodiment of the present disclosure, a contact protrusion 241*a* that is in close contact with the close-contact portion 215 protrudes from the outer surface of the fitting portion 241.

The contact protrusion 241*a* of the fitting portion 241 is supported on the close-contact portion 215 and is pressed and deformed by the fixing ring 280 in this state.

That is, the contact protrusion 241*a* is compressed and crushed.

Accordingly, the gap between the fixing ring 280, the fitting portion 241, and the close-contact portion 215 is further sealed by the contact protrusion 241*a* that is returning.

That is, the compressed air does not leak to the insertion groove 212 of the core pipe 210.

Figure 18:
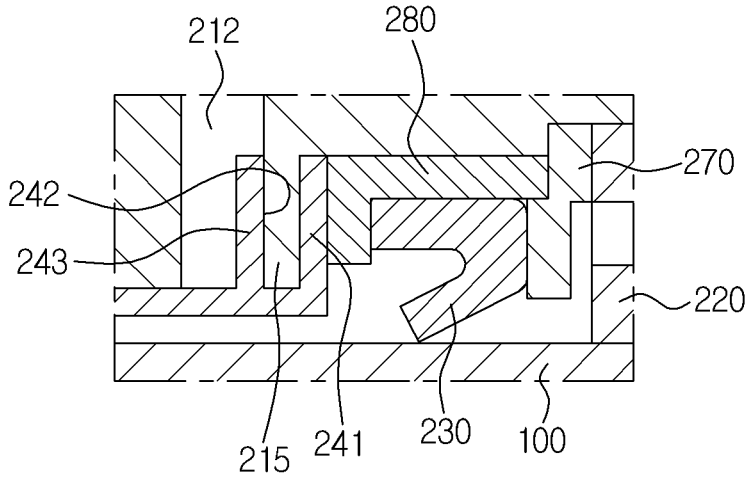
FIG. 18 is a partial enlarged cross-sectional view of the friction shaft for a slitter according to a third modified example of an embodiment of the present disclosure.

Meanwhile, as shown in FIG. 18, in the friction shaft 1000 for a slitter according to a third modified example of an embodiment of the present disclosure, a protrusion 243 protrudes from the outer surface of the tube 240 such that a fitting groove 242 is formed between the fitting portion 241 and the protrusion 243.

The close-contact portion 215 is fitted in the fitting groove 242.

Accordingly, the gap between the fitting portion 241 and the close-contact portion 215 is further sealed by the protrusion 243.

That is, the compressed air does not leak to the insertion groove 212 of the core pipe 210.

Since the close-contact portion 215 is fitted in the fitting groove 242, the tube 240 is further fixed on the inner surface of the core pipe 210.

Figure 19:
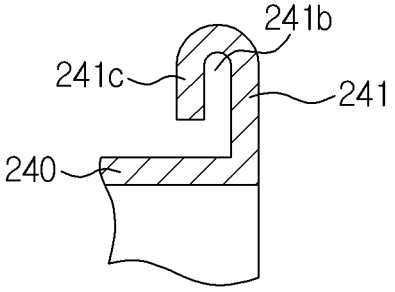
FIGS. 19 and 20 are partial enlarged cross-sectional views of the friction shaft for a slitter according to a fourth modified example of an embodiment of the present disclosure.
Figure 20:
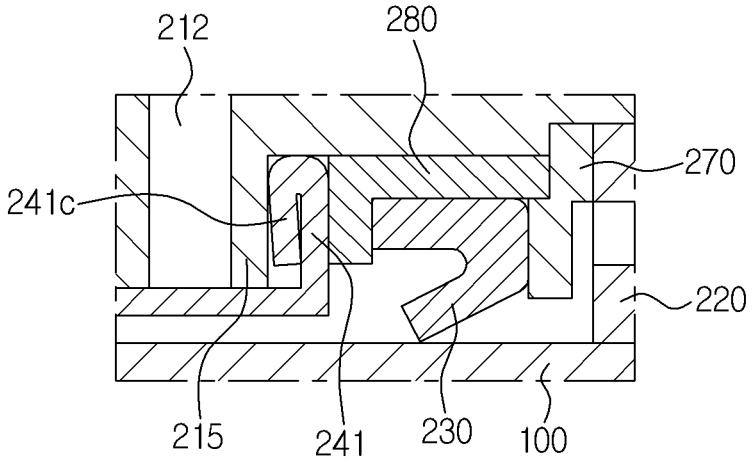

Meanwhile, as shown in FIGS. 19 and 20, in the friction shaft 1000 for a slitter according to a fourth modified example of an embodiment of the present disclosure, a first protrusion 241*c* protrudes from the outer surface of the fitting portion 241 toward the close-contact portion 215 such that a first groove 241*b* is formed between the fitting portion 241 and the first protrusion 241*c*.

The first protrusion 241*c* is in close contact with the close-contact portion 215*b*.

The first protrusion 241*c* of the fitting portion 241 is supported on the close-contact portion 215 and is pressed by the fixing ring 280 in this state, whereby the first groove 241*b* is deformed.

That is, the first protrusion 241*c* is compressed and crushed.

Accordingly, the gap between the fixing ring 280, the fitting portion 241, and the close-contact portion 215 is further sealed by the first protrusion 241*c* that is returning.

That is, the compressed air does not leak to the insertion groove 212 of the core pipe 210.

Figure 21:
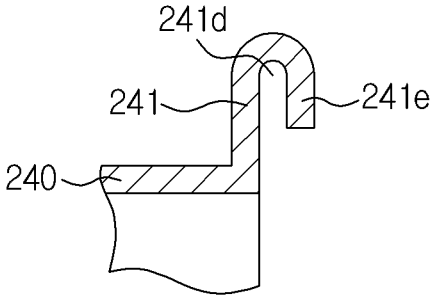
FIGS. 21 and 22 are partial enlarged cross-sectional views of the friction shaft for a slitter according to a fifth modified example of an embodiment of the present disclosure.
Figure 22:
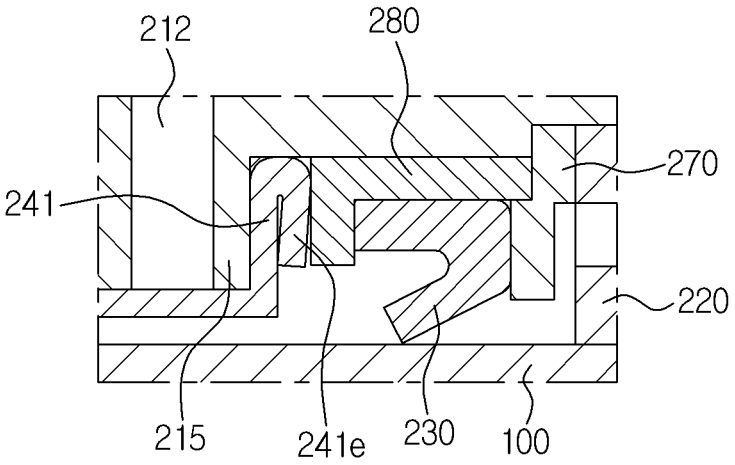

Meanwhile, as shown in FIGS. 21 and 22, in the friction shaft 1000 for a slitter according to a fifth modified example of an embodiment of the present disclosure, a second protrusion 241*e* protrudes from the outer surface of the fitting portion 241 opposite to the close-contact portion 215 such that a second groove 241*d* is formed between the fitting portion 241 and the second protrusion 241*e*.

The second protrusion 241*c* is in close contact with the fixing ring 280.

The second protrusion 241*e* is pressed by the fixing ring 280 and then second groove 241*d* is deformed with the fitting portion 241 supported on the close-contact portion 215.

That is, the second protrusion 241*e* is compressed and crushed.

Accordingly, the gap between the fixing ring 280, the fitting portion 241, and the close-contact portion 215 is further sealed by the second protrusion 241*c* that is returning.

That is, the compressed air does not leak to the insertion groove 212 of the core pipe 210.

Figure 23:
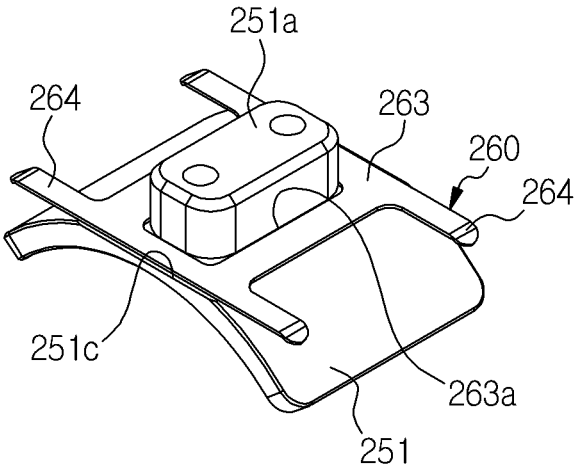
FIGS. 23 to 25 are a perspective view and views showing a use state of the friction shaft for a slitter according to a sixth modified example of an embodiment of the present disclosure.
Figure 24:
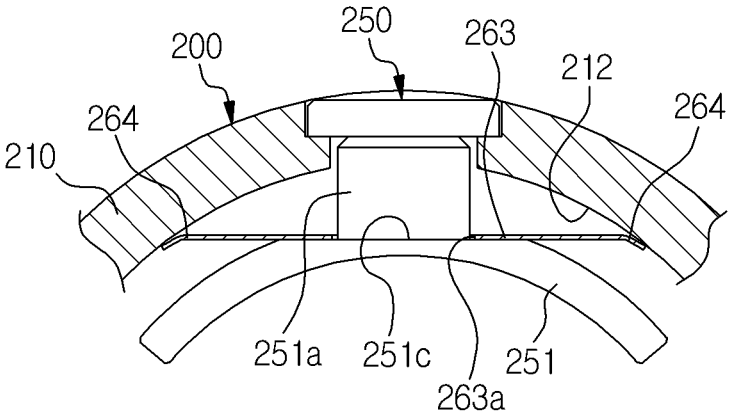
Figure 25:
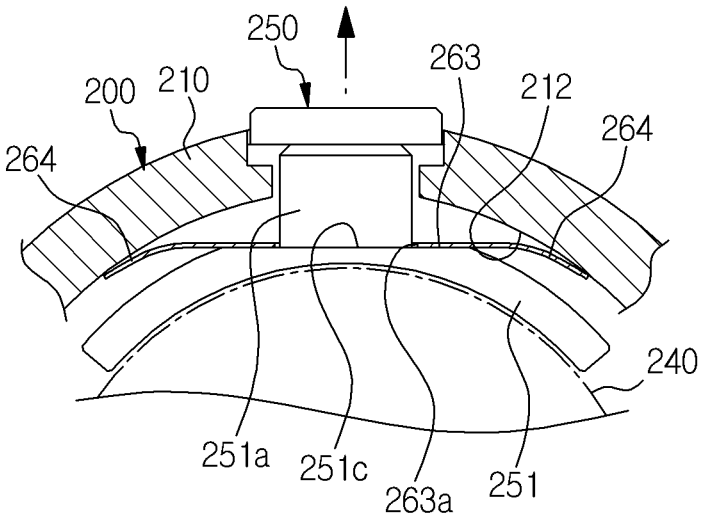

Meanwhile, as shown in FIGS. 23 to 25, in the friction shaft 1000 for a slitter according to a sixth modified example of an embodiment of the present disclosure, a first plane 251*c* that is flat is formed around the protrusion 251*a* on the outer surface of the insertion plate 251.

The elastic member 260 has: a second elastic plate 263 formed in a flat plate shape, being in close contact with the first plane 251*c*, and having a through-hole 263*a* on the outer surface thereof to be fitted on the protrusion 251*a*; and second elastic supporting bridges 264 formed on the outer surface of the second elastic plate 263 at both sides of the through-hole 263*a* and supported in the insertion groove 212.

The second elastic supporting bridges 264 protrude from the corners of the outer surface of the second elastic plate 263, respectively.

When the tube 240 is expanded by compressed air that is supplied through the air supply hole 120, the insertion plate 251 is moved toward the outside of the friction core 200 through the insertion groove 212 by pressure of the expanding tube 240.

In this process, the second elastic supporting bridges 264 of the elastic member 260 are deformed by the moving insertion plate 251 with the second elastic plate 263 supported on the first plane 251*c* and the second elastic supporting bridges 264 supported in the insertion groove 212.

When compressed air is stopped being supplied to the rotary shaft 100, the tube 240 contracts into the initial state with reduction of the compressed air and the second elastic supporting bridges 264 of the elastic member 260 are returned into the initial state from the deformed state by elasticity.

Figure 26:
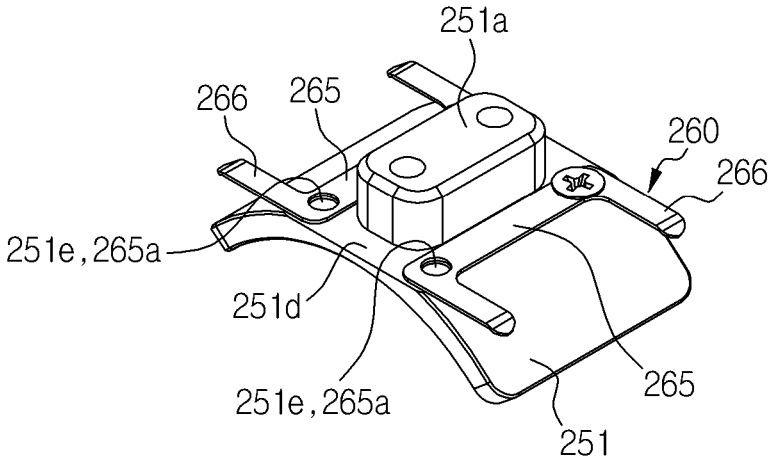
FIGS. 26 to 28 are a perspective view and views showing a use state of the friction shaft for a slitter according to a seventh modified example of an embodiment of the present disclosure.
Figure 27:
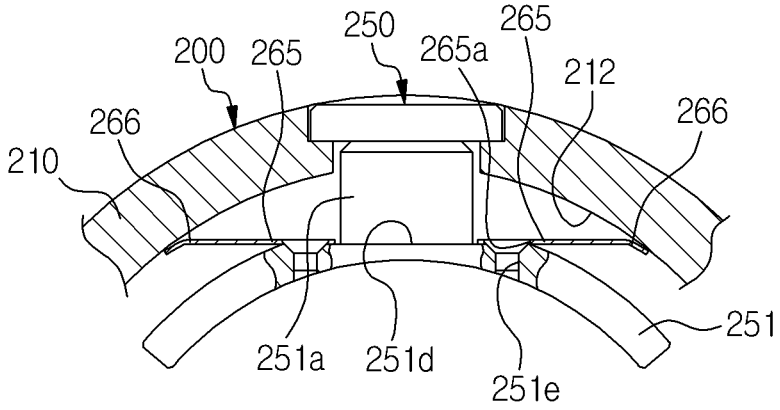
Figure 28:
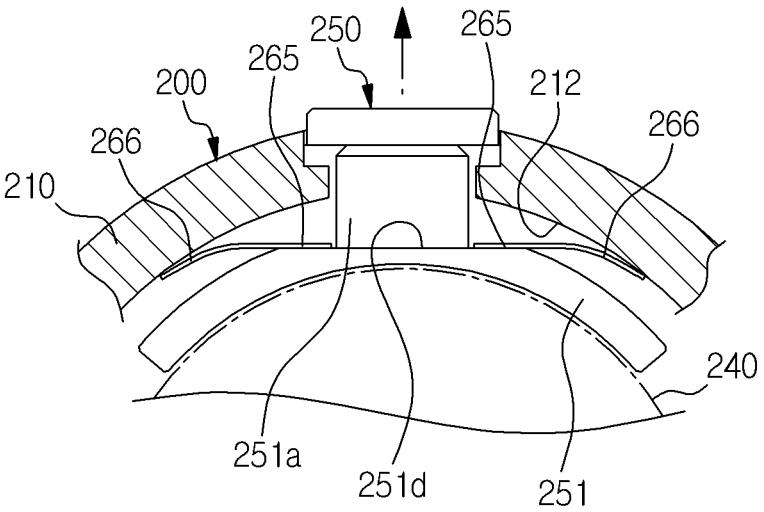

Meanwhile, as shown in FIGS. 26 to 28, in the friction shaft 1000 for a slitter according to a seventh modified example of an embodiment of the present disclosure, a second plane 251*d* that is flat is formed around the protrusion 251*a* on the outer surface of the insertion plate 251 and fastening holes 251*e* are formed at each of both sides of the protrusion 251*a* through the second plane 251*d*.

The elastic member 260 has: a pair of third elastic plates 265 formed in flat plate shapes, being in close contact with the second plane 251*d* at both sides of the protrusion 251*a*, respectively, and having fastening holes 265*a* formed on the outer surface thereof to be coupled to the fastening holes 251*e* by fasteners; and third elastic supporting bridges 266 formed on the outer surface of the third elastic plates 265 and supported in the insertion groove 212.

The third elastic supporting bridges 266 protrude from the corners of the outer surfaces of the third elastic plates 265, respectively.

The third elastic plates 265 are fixed to the insertion plate 251 by fasteners that fix the fastening holes 251*e* and 265*e* through riveting or bolting.

When the tube 240 is expanded by compressed air that is supplied through the air supply hole 120, the insertion plate 251 is moved toward the outside of the friction core 200 through the insertion groove 212 by pressure of the expanding tube 240.

In this process, the third elastic supporting bridges 266 are deformed by the moving insertion plate 251 with the third elastic plates 265 of the elastic member 260 fixed and supported on the second plane 251*d* by fastening the fastening holes 251*e* and 265*e* and with the third elastic supporting bridges 266 supported in the insertion groove 212.

When compressed air is stopped being supplied to the rotary shaft 100, the tube 240 contracts into the initial state with reduction of the compressed air and the third elastic supporting bridges 266 of the elastic member 260 are returned into the initial state from the deformed state by elasticity.

Figure 29:
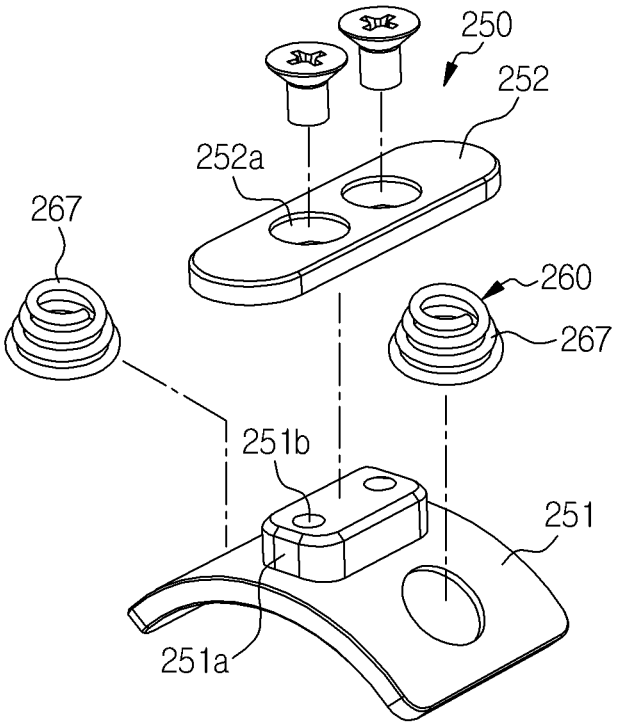
FIGS. 29 to 31 are a perspective view and views showing a use state of the friction shaft for a slitter according to an eighth modified example of an embodiment of the present disclosure.
Figure 30:
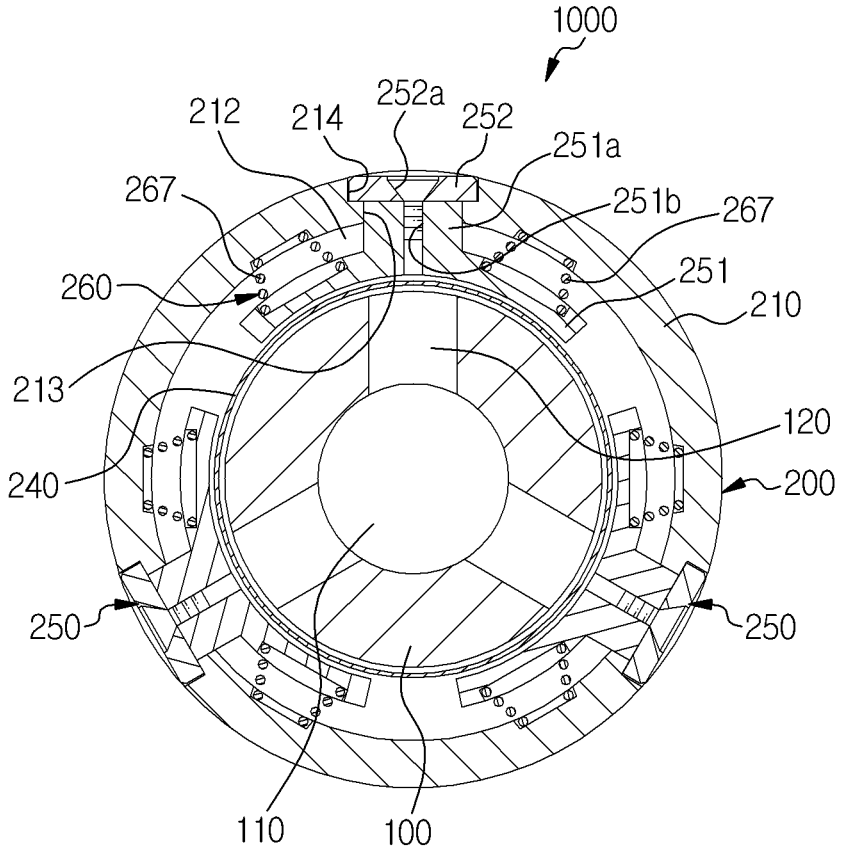
Figure 31:
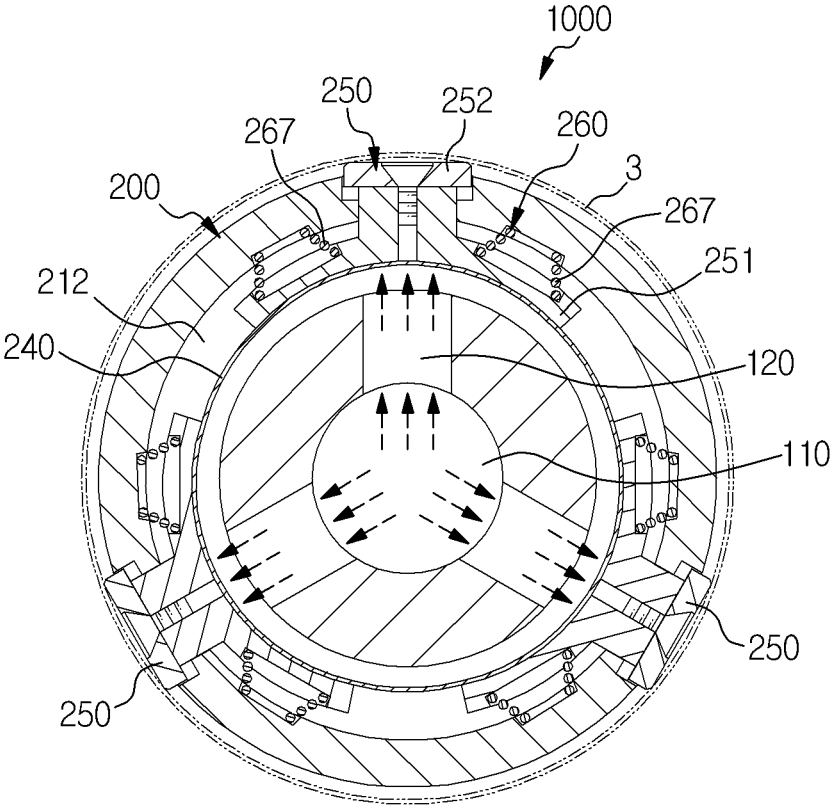

Meanwhile, as shown in FIGS. 29 to 31, the elastic member 260 of the friction shaft 1000 for a slitter according to an eighth modified example of an embodiment of the present disclosure includes coil springs 267 of which both sides are supported by the insertion groove 212 and the insertion plate 251, respectively.

In this configuration, the coil springs 267 are disposed at both sides of the protrusion 251*a*, respectively, between the insertion groove 212 and the insertion plate 251.

Grooves in which the coil springs 267 are fitted and fixed are formed on the outer surfaces of the insertion groove 212 and the insertion plate 251.

The coil springs 267 may be made of metal, or the like.

When the tube 240 is expanded by compressed air that is supplied through the air supply hole 120, the insertion plate 251 is moved toward the outside of the friction core 200 through the insertion groove 212 by pressure of the expanding tube 240.

In this process, the coil springs 267 is deformed and compressed by the insertion plate 251 with both sides supported by the insertion groove 212 and the insertion plate 251.

When compressed air is stopped being supplied to the rotary shaft 100, the tube 240 contracts into the initial state with reduction of the compressed air and the coil springs 267 of the elastic member 260 are returned into the initial state from the deformed state by elasticity.

Although the present disclosure was described above with reference to specific embodiments, the present disclosure is not limited to the embodiments and may be changed and modified in various ways by those skilled in the art without departing from the scope of the present disclosure.

What is claimed is:

1. A friction shaft for a slitter that is configured such that winding pipes for rolling unit materials, which are formed by cutting a raw material such as various kinds of paper, fabric, or film with predetermined intervals, are disposed on an outer surface thereof and that is configured to achieve both strong clamping and wide-range variable torque using one air pressure supply channel, the friction shaft comprising:

a rotary shaft (100) having an air supply channel (110) formed at a center therein to be supplied with compressed air in a longitudinal direction; and several friction cores (200) disposed on the rotary shaft (100) to be able to rotate at positions thereof, wherein several air supply holes (120) connected to the air supply channel (110) are formed circumferentially on an outer surface of the rotary shaft (100) so that compressed air in the friction cores (200) can be supplied, and the friction cores (200) each include: a core pipe (210) having a through-hole (211) formed at the center thereof to be fitted on the rotary shaft (100), an insertion groove (212) formed in a ring shape at a center on an inner surface thereof to face the air supply hole (120), and exposure holes (214) circumferentially formed on an outer surface thereof and connected to the insertion groove (212) and connection holes (213); bearings (220) disposed at both sides of the through-hole (211); sealing rings (230) disposed between the insertion groove (212) and the pair of bearings (220), respectively; a cylindrical tube (240) configured to cover and finish the insertion groove (212) between the pair of sealing rings (230), and configured to be expanded by compressed air that is supplied from the air supply hole (120); clamping lugs (250) disposed in the insertion groove (212), the connection holes (213), and the exposure holes (214) and configured to be partially protruded from the exposure holes (214) by expansion of the tube (240) to come in close contact with a winding pipe; and elastic members (260) disposed between the insertion groove (212) and the clamping lugs (250) to partially insert the clamping lugs (250) back into the exposure holes (214) when supply of the compressed air is stopped.

2. The friction shaft of claim 1, wherein a groove (231) facing the tube (240) is formed on an outer surface of each of the pair of sealing rings (230).

3. The friction shaft of claim 1, wherein the clamping lug (250) includes:

an insertion plate (251) curved to be inserted in the insertion groove (212), having a protrusion (251*a*) protruding from a center of an outer surface thereof to be inserted in the connection hole (213), and having fastening holes (251*b*) formed on an outer surface of the protrusion (251*a*); and a close-contact plate (252) inserted in the exposure hole (214) and having fastening holes (252*a*) formed on an outer surface thereof for fastening to the fastening holes (251*b*), and the elastic member (260) is disposed between the insertion groove (212) and the insertion plate (251).

4. The friction shaft of claim 3, wherein the elastic member (260) has:

a first elastic plate (261) having a through-hole (261*a*) on an outer surface thereof to be fitted on the protrusion (251*a*) and curved to be supported in the insertion groove (212); and first elastic supporting bridges (262) formed on the outer surface of the first elastic plate (261) at both sides of the through-hole (261*a*) and supported on the insertion plate (251).

5. The friction shaft of claim 3, wherein a length of an insertion plate (251) in a circumferential direction of the core pipe (210) is set large such that the insertion plate (251) is adjacent to an adjacent insertion plate (251), and a width of the insertion plates (251) in a longitudinal direction of the core pipe (210) is set large to be close to a width of the insertion groove (212).

6. The friction shaft of claim 3, wherein a first plane (251*c*) is formed around the protrusion (251*a*) on an outer surface of the insertion plate (251), and the elastic member (260) has:

a second elastic plate (263) formed in a flat plate shape, being in close contact with the first plane (251*c*), and having a through-hole (263*a*) on an outer surface thereof to be fitted on the protrusion (251*a*); and second elastic supporting bridges (264) formed on the outer surface of the second elastic plate (263) at both sides of the through-hole (263*a*) and supported in the insertion groove (212).

7. The friction shaft of claim 3, wherein a second plane (251*d*) is formed around the protrusion (251*a*) on an outer surface of the insertion plate (251), fastening holes (251*e*) are formed at each of both sides of the protrusion (251*a*) through the second plane (251*d*), and the elastic member (260) has:

a pair of third elastic plates (265) formed in flat plate shapes, being in close contact with the second plane (251*d*) at both sides of the protrusion (251*a*), respectively, and having fastening holes (265*a*) formed on an outer surface thereof to be coupled to the fastening holes (251*e*) by fasteners; and third elastic supporting bridges (266) formed on an outer surface of the third elastic plates (265) and supported in the insertion groove (212).

8. The friction shaft of claim 3, wherein the elastic member (260) includes coil springs (267) of which both sides are supported by the insertion groove (212) and the insertion plate (251), respectively.

9. The friction shaft of claim 1, wherein fitting portions (241) are formed at both sides of an outer surface of the tube (240), and close-contact portions (215) fitted between the pair of fitting portions (241) are formed on an inner surface of the core pipe (210) at both sides of the insertion groove (212), respectively.

10. The friction shaft of claim 9, wherein the friction core (200) includes:

washers (270) disposed between the bearings (220) and the sealing rings (230) in close contact with outer races of the bearings (220); and fixing rings (280) disposed between the washers (270) and the fitting portions (241) to fix the sealing rings (230) between the washers (270) and the fixing rings (280).

11. The friction shaft of claim 9, wherein a contact protrusion (241*a*) being in close contact with the close-contact portion (215) is formed on an outer surface of the fitting portion (241).

12. The friction shaft of claim 9, wherein a protrusion (243) is formed on the outer surface of the tube (240) such that a fitting groove (242) is formed between the fitting portion (241) and the protrusion (243), and the close-contact portion (215) is fitted in the fitting groove (242).

13. The friction shaft of claim 9, wherein a first protrusion (241*c*) is formed on an outer surface of the fitting portion (241) to face the close-contact portion (215) such that a first groove (241*b*) is formed between the fitting portion (241) and the first protrusion (241*c*).

14. The friction shaft of claim 9, wherein a second protrusion (241*e*) is formed on an outer surface of the fitting portion (241) opposite to the close-contact portion (215) such that a second groove (241*d*) is formed between the fitting portion (241) and the second protrusion (241*e*).

* * * * *